United States Patent [19]

Bilsbury

[11] 4,096,804

[45] Jun. 27, 1978

[54] PLASTIC/MISCHMETAL INCENDIARY PROJECTILE

[75] Inventor: Stephen J. Bilsbury, Shalimar, Fla.

[73] Assignee: The United States of America as represented by the Secretary of the Air Force, Washington, D.C.

[21] Appl. No.: 776,387

[22] Filed: Mar. 10, 1977

[51] Int. Cl.[2] ..... F42B 13/14

[52] U.S. Cl. ..... 102/66; 102/92.2; 102/93

[58] Field of Search ..... 102/6, 52, 65, 66, 90, 102/92.2, 92.3, 92.4, 93

[56] References Cited

U.S. PATENT DOCUMENTS

| | | | |
|---|---|---|---|
| 3,580,178 | 5/1971 | Kopsch | 102/92.2 |
| 3,861,311 | 1/1975 | Bilsbury | 102/90 |
| 4,015,528 | 4/1977 | Barr | 102/93 |

FOREIGN PATENT DOCUMENTS

| | | | |
|---|---|---|---|
| 2,350,699 | 4/1974 | Germany | 102/52 |

*Primary Examiner*—Verlin R. Pendegrass
*Attorney, Agent, or Firm*—Joseph E. Rusz; Arsen Tashjian

[57] ABSTRACT

An incendiary projectile having a plastic jacket made from glass reinforced Nylon, a mischmetal/aluminum core and a Teflon tip is actuated by kinetic energy on impact with the target. The mischmetal/aluminum core is octagonal in configuration and is composed of a pyrophoric alloy containing 87% mischmetal and 13% aluminum. The Teflon tip provides greatly increased effectiveness against targets of aluminum construction especially those containing aircraft fuel and the like.

5 Claims, 5 Drawing Figures

PLASTIC/MISCHMETAL INCENDIARY PROJECTILE

STATEMENT OF GOVERNMENT INTEREST

The invention described herein may be manufactured and used by or for the Government for governmental purposes without the payment of any royalty thereon.

BACKGROUND OF THE INVENTION

This invention relates to a plastic incendiary projectile and, more particularly, the invention is concerned with providing an incendiary projectile having a plastic jacket, a mischmetal/aluminum core and a Teflon tip.

Heretofore, the standard design for incendiary projectiles includes a core for containing incendiary material enclosed in a jacket of gilding metal or the like. The jacket is generally attached to the core by crimping or otherwise forming to fit a shoulder on the core which is usually a hollow steel tube or the like. The main charge of explosive or incendiary material is loaded into the core while the primer is located in a chamber in the nose portion. Even though considerable improvements have been made to the earlier known incendiary projectiles, the requirement of a main explosive charge with a primer which is activated on impact is still the type generally available for use. It is obvious that there are many inherent disadvantages to this arrangement of elements especially the danger of premature explosion of the primer or main charge or both. This can occur during assembly, loading or in the weapon while passing through the bore.

Thus, it would be especially advantageous to provide a plastic projectile which is incendiary only in conjunction with kinetic energy. This type of projectile would insure that no accidental explosion could take place during loading of primers or charges. Also, it would be desirable against targets such as containers of flammable fluids to provide a projectile which would penetrate the container prior to explosion so that the incendiary charge could function properly and initiate burning of the contents. All of this should be accomplished while still keeping the cost per unit low and not causing undue deterioration of the weapon barrel from which the projectile is fired.

SUMMARY OF THE INVENTION

The present invention is concerned with providing a plastic incendiary projectile wherein the jacket including an integral rotating band is injection molded of a thermoplastic material. A core of mischmetal-/aluminum alloy having an octagonal configuration is disposed within the jacket which ruptures on contact with the target allowing the mischmetal/aluminum core to break up and produce incendiary damage. A Teflon tip is attached to the forward end of the plastic jacket to increase the effectiveness of the projectile against targets of aluminum construction.

Accordingly, it is an object of the present invention to provide an improved incendiary projectile having an aluminum/mischemetal core and an integral plastic jacket and rotating band to facilitate breaking up on impact for becoming pyrophoric from the available kinetic energy.

Another object of the invention is to provide an improved incendiary projectile having a plastic jacket and being constructed so that the moment of inertia, weight, and center of gravity of the projectile are easily altered.

Still another object of the invention is to provide a plastic incendiary projectile which is relatively easy and economical to manufacture using non-strategic materials by presently known mass production techniques.

A further object of the invention is to provide a projectile which is only incendiary in conjunction with kinetic energy and which can be manufactured at a relatively lower cost than current incendiary projectiles.

A still further object of the invention is to provide an improved incendiary projectile wherein the gun barrel deterioration due to interaction between the copper rotating band and the barrel are substantially reduced by providing the projectile with an integral plastic rotating band.

These and other objects, features and advantages will become more apparent after considering the following description taken in conjunction with the annexed drawings and appended claims.

DESCRIPTION OF A PREFERRED EMBODIMENT

Figure 1:
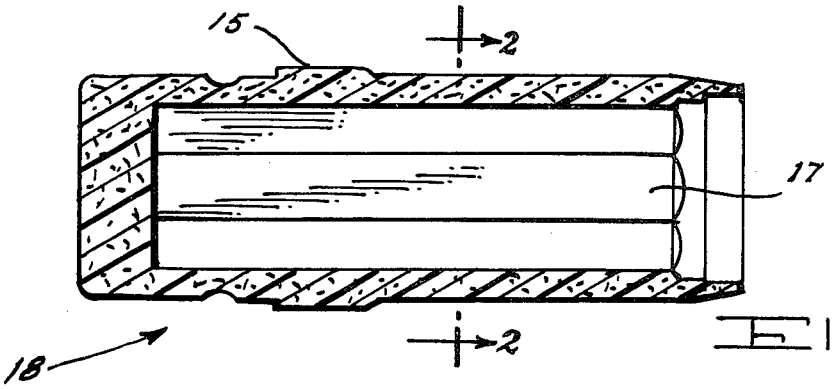
FIG. 1 is a view in longitudinal cross section of the plastic jacket according to the invention showing the integral rotating band and octagonal shaped inner cavity.
Figure 2:
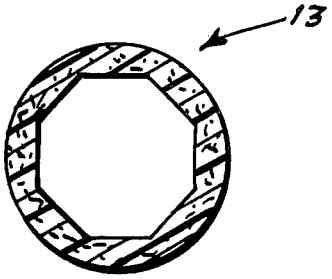
FIG. 2 is a view in cross section of the plastic jacket taken along the line 2—2 of FIG. 1.

Referring now to the drawings, FIG. 1 shows the plastic jacket 13 in longitudinal cross section. In the preferred embodiment shown, the rotating band 15 is integral with the jacket 13 which is fabricated of type 6/12 Nylon, 43% filled with glass. The interior cavity if octagonal in shape (shown most clearly in FIG. 2) to provide a stable and accurate projectile. In the embodiment shown, the configuration of the jacket 13 was patterned after a conventional 20mm projectile.

Figure 3:
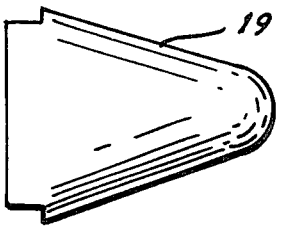
FIG. 3 is a general view of the Teflon tip which fits into the forward open end of the plastic jacket.

In FIG. 3, there is shown a tip or nose 19 which fits into the forward open end of the plastic jacket 13. The nose 19 is preferably fabricated of tetrafluoroethylene resin, commercially available as Teflon. The ogival shape can be produced by utilizing a compression moldable type Teflon. The nose 19 is bonded to the jacket 13 by means of epoxy cement which is cured after assembly.

Figure 4:
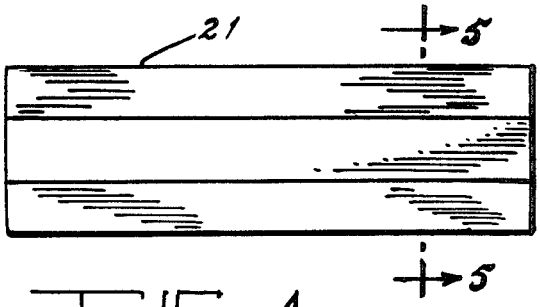
FIG. 4 is a general view of the mischmetal/aluminum alloy core of incendiary material which fits into the inner cavity of the plastic jacket.
Figure 5:
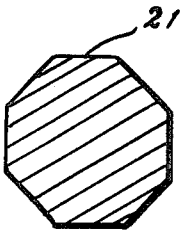
FIG. 5 is a view of the mischmetal/aluminum core in cross section taken along the line 5—5 of FIG. 4.

The core 21 which is shown in FIGS. 4 and 5 is a mischmetal/aluminum alloy. Mischmetal is a commercially available mixture of about 50% cerium, 25% lanthanum and a mixture of other rare earths. A preferred alloy of mischmetal/aluminum is made up of 87% mischmetal and 13% aluminum. The incendiary core 21 is octagonal in configuration and fits into the cavity 17 of the plastic jacket 13. The particular mischmetal/aluminum alloy selected can be readily fabricated, is corrosion resistant, maintains integrity during launch and readily fractures upon target impact. These capabilities are necessary to produce an acceptable projectile which will induce hydraulic shock and ignite fuel present at the target area.

When the projectile is fired against a target which may be a container of fuel or an aircraft fuel tank, the plastic jacket 13 ruptures on impact exposing the core 21. The available kinetic energy causes the mischmetal-/aluminum alloy incendiary material of the core 21 to fracture into lethal particles and thereby become pyrophoric on impact. The Teflon nose 19 improves the effectiveness of the projectile by producing a violent exothermic interaction with the aluminum target panels. An aluminum-fluorine compound is produced as a result of this interaction. Also, the plastic jacket 13 ruptures more easily than a metal jacket to expose the pyrophoric material of the core 21 and has the added advantages of being lower in cost and causing less wear in the weapon barrel.

Thus, it can be seen that the foregoing specification described an incendiary projectile which is safe, simple and reliable and can be easily made from readily available materials. The projectile is very effective in causing damage by fire on impact especially against targets of aluminum construction. As an example of the results obtained with the plastic incendiary projectile according to the invention, a 20mm round having an unetched Teflon nose was fired into an aft fuselage tank and showed a bright impact flash and fire with three distinct flaming pulses of JP-4 fuel. There was sustained internal fire in the tank. The projectile did not exit the tank. In other firings, all fires were internal producing an especially lethal situation in dynamic targets.

The hereinbefore described projectile has special utility for operational use in high performance aircraft gun systems to aid in the reduction of gun barrel erosion and heating and to reduce the cost of the projectile as well as reduce the use of critical materials (copper) while at the same time providing a highly effective incendiary projectile.

Although the invention has been illustrated in the accompanying drawings and described in the foregoing specification in terms of a preferred embodiment thereof, the invention is not limited to this embodiment or to the preferred configuration mentioned. It will be apparent to those skilled in the art that my invention could have extensive use in other operations where it is desirable to provide an incendiary projectile which is suitable for use on all calibers of aircraft machine gun ammunition as well as with larger caliber guns where the required ballistic properties may vary over a wide range. The use of the unusual combination of materials which have different specific weights allows the matching of the over-all volume with the dimensions and weight ratio to provide the required center of gravity and moment of inertia for proper flight and ballistic properties.

Having thus set forth the nature of my invention, what I claim and desire to secure by Letters Patent of the United States is:

1. A plastic incendiary projectile for firing through a weapon having a rifled bore comprising a thermoplastic jacket having an integral rotating band disposed around the outer circumference near the rearward end thereof, said thermoplastic jacket having a substantially hollow inner cavity with an open forward end and a closed rearward end, a core of incendiary material substantially filling the inner cavity of said thermoplastic jacket, and a nose tip of resinous material having a low coefficient of friction disposed over the open forward end of said thermoplastic jacket, the impact of the projectile with a target causing the jacket to rupture thereby allowing said core of incendiary material to break up by kinetic energy into lethal particles causing fire to start in the presence of flammable material.

2. The plastic incendiary projectile defined in claim 1 wherein said core of incendiary material is of elongated octagonal configuration and the inner cavity of said jacket is correspondingly shaped to receive said core.

3. The plastic incendiary projectile defined in claim 2 wherein said core of incendiary material is an alloy of 87% mischmetal and 13% aluminum.

4. The plastic incendiary projectile defined in claim 2 wherein said thermoplastic jacket is fabricated of glass filled Nylon.

5. The plastic incendiary projectile defined in claim 2 wherein said nose tip of resinous material is fabricated of tetrafluoroethylene.

* * * * *